United States Patent [19]

Tadd

[11] 4,249,287

[45] Feb. 10, 1981

[54] TAB BUCKLE

[76] Inventor: Roy W. Tadd, 34091 Aurelio Dr., Dana Point, Calif. 92629

[21] Appl. No.: 81,349

[22] Filed: Oct. 3, 1979

[51] Int. Cl.[3] ..... A44B 1/14; A44B 11/00

[52] U.S. Cl. ..... 24/113 R; 24/73 BH; 24/163 K; 24/73 BG

[58] Field of Search ..... 24/73 BG, 73 BH, 73 G, 24/79, 90 A, 90.5, 113 R, 113 MP, 163 K; 40/315; 51/265

[56] References Cited

U.S. PATENT DOCUMENTS

| | | | |
|---|---|---|---|
| 1,499,262 | 6/1924 | Sundt | 24/73 BG |
| 1,502,487 | 7/1924 | Sable | 24/73 BG |
| 1,610,237 | 12/1926 | Belli | 24/73 BG X |
| 1,774,033 | 8/1930 | Myers et al. | 24/113 MP |
| 2,880,487 | 4/1959 | Ryan | 24/113 MP |
| 2,883,725 | 4/1959 | McDonough | 24/113 MP |
| 3,777,336 | 12/1973 | Anderson | 24/113 MP |

FOREIGN PATENT DOCUMENTS

| | | | |
|---|---|---|---|
| 527046 | 3/1954 | Belgium | 24/113 MP |
| 607884 | 1/1935 | Fed. Rep. of Germany | 24/113 MP |

*Primary Examiner*—Thomas J. Holko

*Attorney, Agent, or Firm*—Gordon L. Peterson

[57] ABSTRACT

A tab buckle for a tab on a pair of trousers comprising a body member and an elongated element attached to the body member on the rear face of the body member. A latching member having a locking edge is attached to the body member by a resilient element which resiliently resists movement of the latching member away from the elongated element.

9 Claims, 6 Drawing Figures

Fig. 1
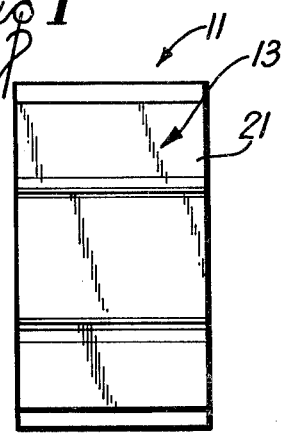
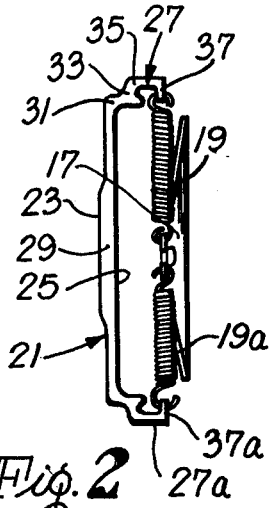
Fig. 2
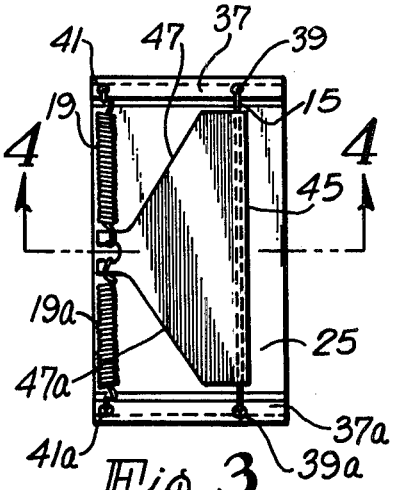
Fig. 3
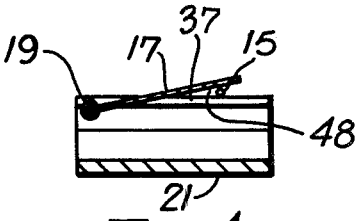
Fig. 4
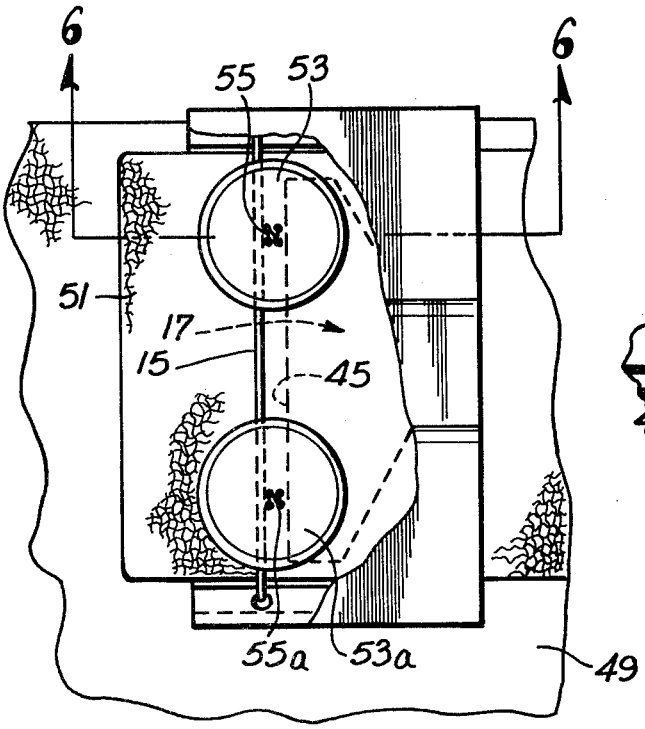
Fig. 5
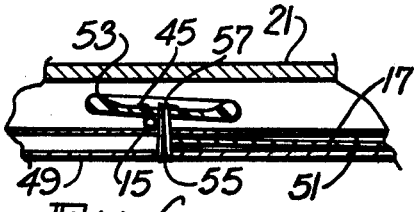
Fig. 6

TAB BUCKLE

BACKGROUND OF THE INVENTION

Trousers of the type which do not require a belt or suspenders typically include a tab or waistband extension which is fastened to the other end of the waistband by buttons, hooks, etc. For example, the tab may have a buttonhole, and the other end of the waistband may carry a tab button which extends through the buttonhole to fasten the tab to the waistband. In this condition, the button is exposed on the exterior of the tab.

SUMMARY OF THE INVENTION

This invention provides a tab buckle for a tab on a pair of trousers. The tab buckle may be used to conceal the tab button or to assist in fastening the tab to the waistband. The tab buckle may be ornamental or decorative in appearance. The tab buckle can be easily fixed in position on the trouser tab and easily released for sliding movement along the tab.

The tab buckle can advantageously include a body member having a front panel with forward and rear faces. The front panel is used to conceal the button and portions of the tab.

To enable the tab buckle to be fixed in position along the trouser tab, the tab buckle includes a first latching member which may be an elongated element and a second latching member having a locking edge. The elongated element is attached to the body member on the rear face of the body member and in spaced relationship to the body member. Resilient means attaches the latching member to the body member on the rear face of the body member. The resilient means resiliently resists movement of the latching member away from the elongated element. With this arrangement, the stem or tuft of thread which holds the button on the trousers can be resiliently gripped between the elongated element and the locking edge of the latching member. Conversely, to release the tab buckle from the tuft of thread of the button, it is only necessary to separate the elongated element and the latching member against the biasing action of the resilient means.

In order to attach the elongated element to the body member, the body member preferably includes first and second mounting sections spaced apart on the rear face of the body member and projecting outwardly from the rear face. Additional mounting sections may be utilized, if desired, to attach the resilient means to the body member. In a preferred construction, the body member includes first and second opposite end walls with the end walls forming such mounting sections. In addition, the end walls serve as guides for the tab buckle as the latter is slid along the trouser tab.

The latching member can advantageously take the form of a latching plate having a first location which is attached to the resilient means. To prevent the latching plate from interfering with resilient movement of the resilient means, the latching plate preferably has inclined edges which extend toward each other as they extend toward the first location.

To simplify the mounting of the latching member on the body member, the resilient means can take the form of one or more coil springs. The coil springs preferably resiliently urge the latching member to pivot so that the locking edge is resiliently urged toward the rear face of the body member.

The elongated element, the resilient means and the latching member are preferably spaced from the rear face of the body member. The elongated element and the latching member define a passage through which the trouser tab can be inserted.

The invention, together with further features and advantages thereof, may best be understood by reference to the following description taken in connection with the accompanying illustrative drawing.

BRIEF DESCRIPTION OF THE DRAWING

FIG. 1 is a front elevational view of a button concealment member constructed in accordance with the teachings of this invention.

FIG. 2 is a side elevational view of the button concealment member.

FIG. 3 is a rear elevational view of the button concealment member.

FIG. 4 is a sectional view taken generally along line 4—4 of FIG. 3 with the latching plate above the elongated element.

FIG. 5 is an enlarged front elevational view of the button concealment member installed on a trouser tab with portions of the front panel being broken away.

FIG. 6 is a sectional view taken generally along line 6—6 of FIG. 5.

BRIEF DESCRIPTION OF THE PREFERRED EMBODIMENT

FIGS. 1–4 show a tab buckle 11 which generally includes a body member 13, an elongated element 15, a latching member 17 and resilient means in the form of identical coil springs 19 and 19*a*. The body member 13 includes a front panel 21 having a forward face 23 and a rear face 25. The body member also includes end walls 27 and 27*a* formed integrally with the upper and lower edges of the front panel 21.

In the embodiment illustrated, the front panel is generally in the form of a flat plate with the forward face 23 having a central raised portion 29. The forward face 23 is preferably decorative or ornamental in nature, and in the embodiment illustrated, the body member is constructed of aluminum coated with 24k gold. Although the forward face 23 in the embodiment illustrated, is relatively plain, it could embody various different designs and shapes of an ornamental and/or artistic nature. In the embodiment illustrated, the rear face 25 is essentially planar.

The end walls 27 and 27*a* may be identical and they project generally prependicularly to the front panel 21. The end walls 27 and 27*a* are essentially parallel to each other and they project from the rear face 25 to form, in effect, a shallow channel with the front panel 21. Although the end walls 27 and 27*a* may be of various different constructions, in the embodiment illustrated, the end wall 27 includes a first leg 31 projecting perpendicularly from the front panel 21, a laterally extending web 33, a second leg 35 extending parallel to the first leg 31 and a flange 37 projecting inwardly of the end wall 27 parallel to the front panel 21. Portions of the end wall 27*a* corresponding to portions of the end wall 27 are designated by corresponding reference numerals followed by the letter "a."

The particular configuration of the end walls 27 and 27*a* is not particularly important, except that the flanges 37 and 37*a* are useful in mounting other components of the tab buckle 11. For example, the elongated element 15, which may be in the form of a wire, has its opposite ends projecting through openings 39 and 39*a* of the flanges 37 and 37*a*, respectively. The opposite ends of the elongated element 15 can be bent or otherwise enlarged to prevent withdrawal of the elongated element from the flanges 37 and 37*a*. Although the elongated element 15 can be constructed of different materials, in the embodiment illustrated, it is constructed of metal. The elongated member 15 is preferably sufficiently rigid to serve a locking function as described more particularly hereinbelow.

The latching member 17 is also mounted on the flanges 37 and 37*a* by the springs 19 and 19*a* which have their outer ends extending respectively through openings 41 and 41*a*. The latching member 17 has a projecting nose 43 defining two prongs to which the inner ends of the springs 19 and 19*a* are attached.

The latching member 17, which in the embodiment illustrated is in the form of a latching plate, has a locking edge 45 extending generally parallel to the elongated element. The latching member 17 also has inclined edges 47 and 47*a* which extend toward each other as they extend toward the nose 43 and the springs 19 and 19*a*.

The springs 19 and 19*a* normally hold the latching member 17 in the position shown in FIGS. 2–4. The springs 19 and 19*a* resiliently resist the movement of the latching member 17 in all directions. Accordingly, the resilient biasing force of the springs must be overcome to move the latching member from its normal position shown in FIGS. 2–4. For example, the springs 19 and 19*a* resiliently permit the latching member 17 to be moved to the left as viewed in FIG. 3 to move the locking edge 45 farther away from the elongated element 15. The slope on the inclined edges 47 and 47*a* prevents these edges from interfering with the springs 19 and 19*a* defining a V-shaped configuration as the latching members move to the left as viewed in FIG. 3.

Another function of the springs 19 and 19*a* is to resiliently urge the locking edge 45 toward the rear face 25. By so doing, the springs 19 and 19*a* completely mount the latching member 17, and there is no need for guides of any kind to position the latching member. In addition, there is a space or passage 48 (FIG. 4) between the elongated element 15 and the locking edge 45. The locking edge 45 preferably lies closely adjacent a plane which contains the elongated element 15 and which is perpendicular to the body member 13. Although the locking edge 45 is linear in the embodiment illustrated, obviously other configurations can be employed for the locking edge.

FIGS. 5 and 6 show one way that the tab buckle 11 can be used. FIG. 5 shows a pair of trousers 49 having a tab or waistband extension 51 secured thereto in the usual manner. A pair of buttons 53 and 53*a* are attached to the trousers 49 by stems of thread or stitching 55 and 55*a*, respectively, and extend through buttonholes 57 (FIG. 6) of the tab 51 when the tab is buttoned to the trousers.

In use, the tab 51 is inserted below the springs 19 and 19*a* and through the opening 48 (FIG. 4) between the elongated element 15 and the latching member 17 when the tab is unbuttoned. After the tab 51 is buttoned to the trousers 49, the tab buckle 11 can be slid along the tab (to the left as viewed in FIG. 5) until the locking edge 45 engages the stitching 55 by manually pulling the body member 13 to the left as viewed in FIG. 5 against biasing action of the springs 19 and 19*a* to pull the elongated element 15 over the top of the button and into the position as shown in FIGS. 5 and 6 on the opposite side of the stitching 55. In this manner, the tab buckle 11 is locked in position over the buttons 53 and 53*a* and completely conceals the buttons. The tab buckle 11 can be easily disengaged by reversing the procedure described above to allow the elongated element 15 to slide over the top or outer side of the buttons thereby permitting the tab buckle 11 to be slid to the right as viewed in FIG. 5. Of course, the front panel 21 should be of large enough area to completely conceal the buttons 53 and 53*a*, the springs 19 and 19*a* and the latching member 17 when the tab buckle is being used as shown in FIGS. 5 and 6.

The tab buckle 11 can also be used when the tab 51 is held in place by fasteners other than the buttons 53 and 53*a*, such as hooks. Also, the tab buckle 11 can be used to fasten the tab 51 to the waistband of the trousers.

Although an exemplary embodiment of the invention has been shown and described, many changes, modifications and substitutions may be made by one having ordinary skill in the art without necessarily departing from the spirit and scope of this invention.

I claim:

1. A tab buckle for a tab on a pair of trousers comprising:

a body member including a front panel having forward and rear faces;

a first latching member;

said body member including first and second mounting sections spaced apart on said rear face of the body member and projecting outwardly from said rear face of the body member;

means for attaching longitudinally spaced regions of the first latching member to the first and second mounting sections, respectively, with the first latching member being on the same side of said body member as said rear face and being spaced from said rear face of the body member over a major length of the first latching member;

a second latching member having a locking edge;

resilient means for attaching the second latching member to the body member with the second latching member being on the same side of said body member as said rear face and with the locking edge being adjacent the first latching member;

said resilient means resiliently resisting movement of the second latching member away from the first latching member whereby the locking edge and the first latching member can resiliently grip an element; and said resilient means resiliently resisting translation of the second latching member in at least one direction away from the first latching member.

2. A tab buckle as defined in claim 1 wherein said resilient means mounts the second latching member to the body member for pivotal movement with respect to the body member.

3. A tab buckle as defined in claim 2 wherein said resilient means resiliently urges said second latching member to pivot in a direction to urge the locking edge toward said rear face of said body member.

4. A tab buckle as defined in claim 1 wherein said first latching member includes an elongated element.

5. A tab buckle as defined in claim 1 wherein said resilient means includes a coil spring coupled to the second latching member and the body member for at least assisting in mounting the second latching member on the body member.

6. A tab buckle for a tab on a pair of trousers comprising:

a body member including a front panel having forward and rear faces;

a first latching member;

said body member including first and second mounting sections spaced apart on said rear face of the body member and projecting outwardly from said rear face of the body member;

means for attaching longitudinally spaced regions of the first latching member to the first and second mounting sections, respectively, with the first latching member being on the same side of said body member as said rear face and being spaced from said rear face of the body member over a major length of the first latching member;

a second latching member having a locking edge;

resilient means for attaching the second latching member to the body member with the second latching member being on the same side of said body member as said rear face and with the locking edge being adjacent the first latching member;

said resilient means resiliently resisting movement of the second latching member away from the first latching member whereby the locking edge and the first latching member can resiliently grip an element; and said body member including third and fourth mounting sections spaced apart on said rear face of the body member and projecting outwardly from said rear face of the body member and said resilient means mounts said second latching member on said third and fourth mounting sections with the second latching member being spaced from said rear face of the body member over a major portion of the area thereof.

7. A tab buckle for a tab on a pair of trousers comprising:

a body member including a front panel having forward and rear faces;

a first latching member;

said body member including first and second mounting sections spaced apart on said rear face of the body member and projecting outwardly from said rear face of the body member;

means for attaching longitudinally spaced regions of the first latching member to the first and second mounting sections, respectively, with the first latching member being on the same side of said body member as said rear face and being spaced from said rear face of the body member over a major length of the first latching member;

a second latching member having a locking edge;

resilient means for attaching the second latching member to the body member with the second latching member being on the same side of said body member as said rear face and with the locking edge being adjacent the first latching member;

said resilient means resiliently resisting movement of the second latching member away from the first latching member whereby the locking edge and the first latching member can resiliently grip an element; and said body member including first and second opposite end walls integral with said body member, said first and second end walls being spaced apart and including said first and second mounting sections, respectively, said resilient means attaching said second latching member to said first and second end walls.

8. A tab buckle for a tab on a pair of trousers comprising:

a body member including a front panel having forward and rear faces;

a first latching member;

said body member including first and second mounting sections spaced apart on said rear face of the body member and projecting outwardly from said rear face of the body member;

means for attaching longitudinally spaced regions of the first latching member to the first and second mounting sections, respectively, with the first latching member being on the same side of said body member as said rear face and being spaced from said rear face of the body member over a major length of the first latching member;

a second latching member having a locking edge;

resilient means for attaching the second latching member to the body member with the second latching member being on the same side of said body member as said rear face and with the locking edge being adjacent the first latching member;

said resilient means resiliently resisting movement of the second latching member away from the first latching member whereby the locking edge and the first latching member can resiliently grip an element; and said second latching member includes a latching plate having a first location at which the latching plate is attached to the resilient means and inclined edges which extend toward each other as they extend toward said first location.

9. A tab buckle for a tab on a pair of trousers comprising:

a body member including a front panel having forward and rear faces;

a first latching member;

said body member including first and second mounting sections spaced apart on said rear face of the body member and projecting outwardly from said rear face of the body member;

means for attaching longitudinally spaced regions of the first latching member to the first and second mounting sections, respectively, with the first latching member being on the same side of said body member as said rear face and being spaced from said rear face of the body member over a major length of the first latching member;

a second latching member having a locking edge;

resilient means for attaching the second latching member to the body member with the second latching member being on the same side of said body member as said rear face and with the locking edge being adjacent the first latching member;

said resilient means resiliently resisting movement of the second latching member away from the first latching member whereby the locking edge and the first latching member can resiliently grip an element;

said first latching member including an elongated element; and said body member including end walls, said end walls including said first and second mounting sections, said resilient means being attached to said latching plate and to said end walls, said resilient means urges the latching plate to pivot in a direction to urge the locking edge toward said rear face of said body member, and said resilient means includes a coil spring extending between said latching plate and one of said end walls.

* * * * *